US011834732B2

(12) United States Patent
Wang et al.

(10) Patent No.: US 11,834,732 B2
(45) Date of Patent: Dec. 5, 2023

(54) METHOD OF ELIMINATING MICROSTRUCTURE INHERITANCE OF HYPEREUTECTIC ALUMINUM-SILICON ALLOYS

(71) Applicants: GM Global Technology Operations LLC, Detroit, MI (US); Shanghai Jiao Tong University, Shanghai (CN)

(72) Inventors: Qigui Wang, Rochester Hills, MI (US); Wenying Yang, Rochester Hills, MI (US); Bing Ye, Minhang (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 70 days.

(21) Appl. No.: 17/529,950

(22) Filed: Nov. 18, 2021

(65) Prior Publication Data

US 2023/0145566 A1 May 11, 2023

(30) Foreign Application Priority Data

Nov. 5, 2021 (CN) ..... 202111305932.3

(51) Int. Cl.
*C22C 1/02* (2006.01)

(52) U.S. Cl.
CPC ..... *C22C 1/026* (2013.01)

(58) Field of Classification Search
CPC .. C22C 1/026; C22B 9/02; C22B 9/16; B22D 7/005; B22D 21/04
See application file for complete search history.

(56) References Cited

U.S. PATENT DOCUMENTS 6,994,147 B2 * 2/2006 Saha ..... C22C 1/12 164/113
2002/0000273 A1 * 1/2002 Wang ..... C22F 1/043 148/698

FOREIGN PATENT DOCUMENTS

CN 108588512 A 9/2018
CN 108677070 A 10/2018
CN 113444899 A 9/2021

OTHER PUBLICATIONS

Hernandez et al., "Comparison among chemical and electromagnetic stirring and vibration melt treatment for Al—Si hypereutectic alloys," Journal of Alloys and Compounds, 426 (2006), p. 205-212. (Year: 2006).*

(Continued)

*Primary Examiner* — John A Hevey
(74) *Attorney, Agent, or Firm* — Vivacqua Crane, PLLC

(57) ABSTRACT

A method of eliminating microstructure inheritance of hypereutectic aluminum-silicon alloys. The method includes heating a first amount of the Al—Si alloy to a predetermined temperature above a liquidus temperature of the Al—Si alloy to form a first amount melt; holding the first amount melt at the predetermined temperature for a predetermined amount of time; stirring the first amount melt during the predetermined amount of time; heating a second amount of the Al—Si alloy above the liquidus temperature of the Al—Si alloy to form a second amount melt; and mixing the first amount melt and the second amount melt to form a processed Al—Si casting alloy. The predetermined temperature is between about 750° C. to 850° C. The predetermined amount of time is between 0.1 hour to 0.5 hour. The processed Al—Si casting alloy contains about 30 wt % to about 40 wt % of the first amount of the Al—Si alloy.

20 Claims, 5 Drawing Sheets

(56) References Cited

OTHER PUBLICATIONS

Yan et al. "Evolution of solidification structures and mechanical properties of high-Si Al alloys under permanent magnetic stirring," Materials Characterization, 2019, pp. 1-33, vol. 157.

* cited by examiner

METHOD OF ELIMINATING MICROSTRUCTURE INHERITANCE OF HYPEREUTECTIC ALUMINUM-SILICON ALLOYS

INTRODUCTION

The present disclosure relates to methods of processing casting aluminum alloys, more particularly to a method of eliminating microstructure inheritance of hypereutectic aluminum-silicon alloys.

Hypereutectic aluminum-silicon (Al—Si) alloys are widely used in the automobile industries due to their low density, excellent wear and corrosion resistance, low coefficient of thermal expansion, good strength, and excellent castability. They are used in applications that typically require a combination of light weight and high wear resistance, including, but not limited to engine blocks, pistons, transmission casings, and transmission clutch housings. The performance of Al—Si alloys depends on the microstructure inheritance of these alloys. Hypereutectic Al—Si alloys having uniform distribution of fine silicon particles have higher strength and better wear resistance.

Typical Al—Si alloys used for the casting of transmission clutch housings include a B390 Al—Si alloy. B390 Al—Si alloy used for casting has a microstructure inheritance of relatively large Si particles that can lead to coarse primary Si particles in the completed cast workpieces. Coarse primary SI particles may significantly reduce the alloy ductility of the transmission clutch housing.

Thus, while Al—Si alloys used for casting transmission clutch housings achieve their intended purpose, there is a need for a method of eliminating microstructure inheritance of relatively large primary Si particles to improve the strength of the transmission clutch housings.

SUMMARY

According to several aspects, a method of eliminating microstructure inheritance in a hypereutectic aluminum-silicon (Al—Si) alloy is disclosed. The method includes, heating a first amount of the Al—Si alloy to a predetermined temperature above a liquidus temperature of the Al—Si alloy to form a first amount melt; holding the first amount melt at the predetermined temperature for a first predetermined amount of time; and stirring the first amount melt for a second predetermined amount of time. The first predetermined amount of time is between 0.1 hour to 0.5 hour. The second predetermined amount of time may be equal to or less than the first predetermined amount of time.

In an additional aspect of the present disclosure, the method further includes heating a second amount of the Al—Si alloy above the liquidus temperature of the Al—Si alloy to form a second amount melt, and mixing a stirred first amount melt with the second amount melt to form a processed Al—Si alloy.

In another aspect of the present disclosure, the predetermined temperature is greater than 800° C., preferably between about 750° C. to about 850° C., and more preferably between about 790° C. to about 810° C.

In another aspect of the present disclosure, wherein stirring the first amount melt includes contact-less magnetic stirring.

In another aspect of the present disclosure, wherein the processed Al—Si alloy includes a first amount melt from about 25 weight percent (wt %) to about 50 w %.

According to several aspects, a method of casting a workpiece is disclosed. The method includes heating an Al—Si alloy to a processing temperature between about 750° C. to about 850° C. to form an Al—Si alloy melt; maintaining the Al—Si alloy melt at the processing temperature for a processing time between about 0.1 hour to about 0.5 hour to form a processed Al—Si alloy melt; and pouring the processed Al—Si alloy melt into a mold cavity defining the workpiece.

In an additional aspect of the present disclosure, mixing a non-processed Al—Si alloy melt to the processed Al—Si alloy melt to form a casting alloy mixture; and pouring the casting alloy mixture into the mold cavity defining the workpiece.

In another aspect of the present disclosure, the method further includes stirring the Al—Si alloy melt at the processing temperature for the processing time between about 0.1 hour to about 0.5 hour to form the processed Al—Si alloy melt In another aspect of the present disclosure, the casting alloy mixture includes about 30 weight percent (wt %) to about 40 wt % of the processed Al—Si alloy melt, preferably 35 wt %.

According to several aspects, a method of processing a hypereutectic aluminum-silicon (Al—Si) alloy for casting. The method includes heating an Al—Si alloy to form an Al—Si alloy melt; stirring a first portion of the Al—Si alloy melt for a predetermined time at a predetermined temperature to form a processed Al—Si alloy melt; and mixing a second portion of the Al—Si alloy melt to the processed Al—Si alloy melt to form a processed Al—Si casting alloy. The predetermined time is from about 0.1 hour to about 0.5 hour. The predetermined temperature is from about 750° C. to about 850° C. The processed Al—Si casting alloy comprises about 30 weight percent (wt %) to about 40 wt % of the processed Al—Si alloy melt. Stirring the first portion of the Al—Si alloy melt includes contact-less magnetic stirring.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses. The illustrated embodiments are disclosed with reference to the drawings, wherein like numerals indicate corresponding parts throughout the several drawings. The figures are not necessarily to scale and some features may be exaggerated or minimized to show details of particular features. The specific structural and functional details disclosed are not intended to be interpreted as limiting, but as a representative basis for teaching one skilled in the art as to how to practice the disclosed concepts.

Figure 1:
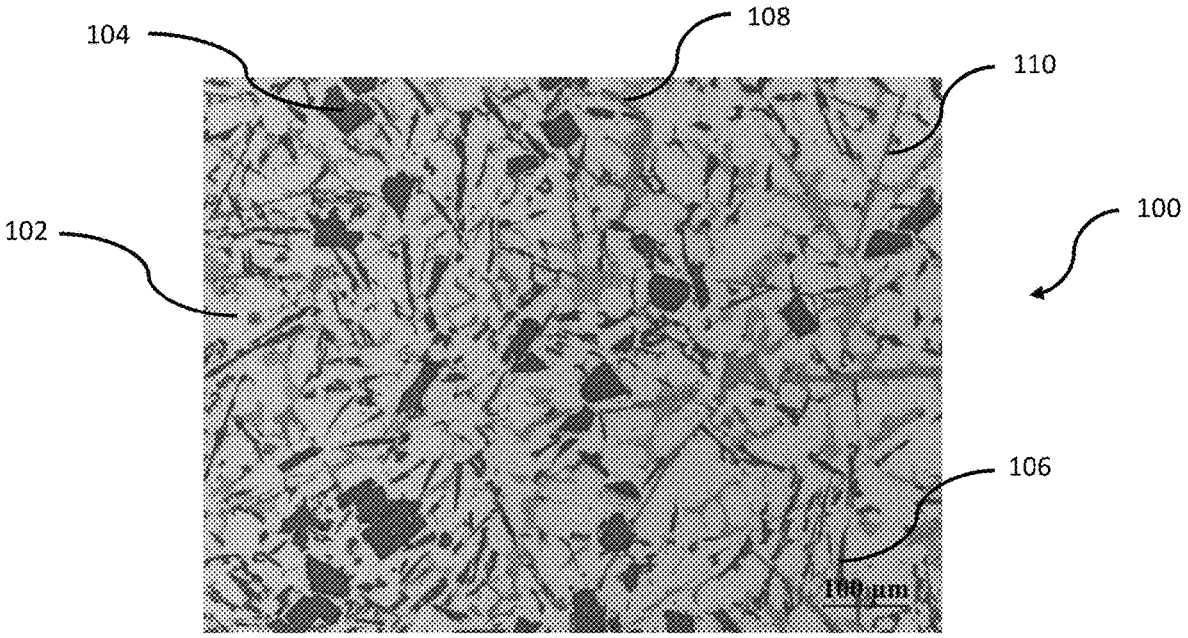
FIG. 1 is a micrograph of a hypereutectic aluminum-silicon alloy before processing with a method of eliminating microstructure inheritance.

FIG. 1 shows a micrograph 100 of a B390 hypereutectic aluminum-silicon alloy casting, also referred to as a B390 Al—Si alloy, before processing with a method of eliminating microstructure inheritance, which is disclosed in detail below. The micrograph 100 shows a microstructure of the B390 Al—Si alloy having an Aluminum (Al) matrix 102 surrounding primary Silicon (Si) particles 104, eutectic Si particles 106, $\alpha$-Fe($Al_{15}$(Fe,Mn)$_3Si_2$ 108, and $\beta$-Fe ($Al_5FeSi$) 110. The Fe($Al_{15}$(Fe,Mn)3$Si_2$ 108, and $\beta$-Fe ($Al_5FeSi$) 110 are also referred to as Alpha Phase 108 and Beta Phase 110, respectively.

Figure 2:
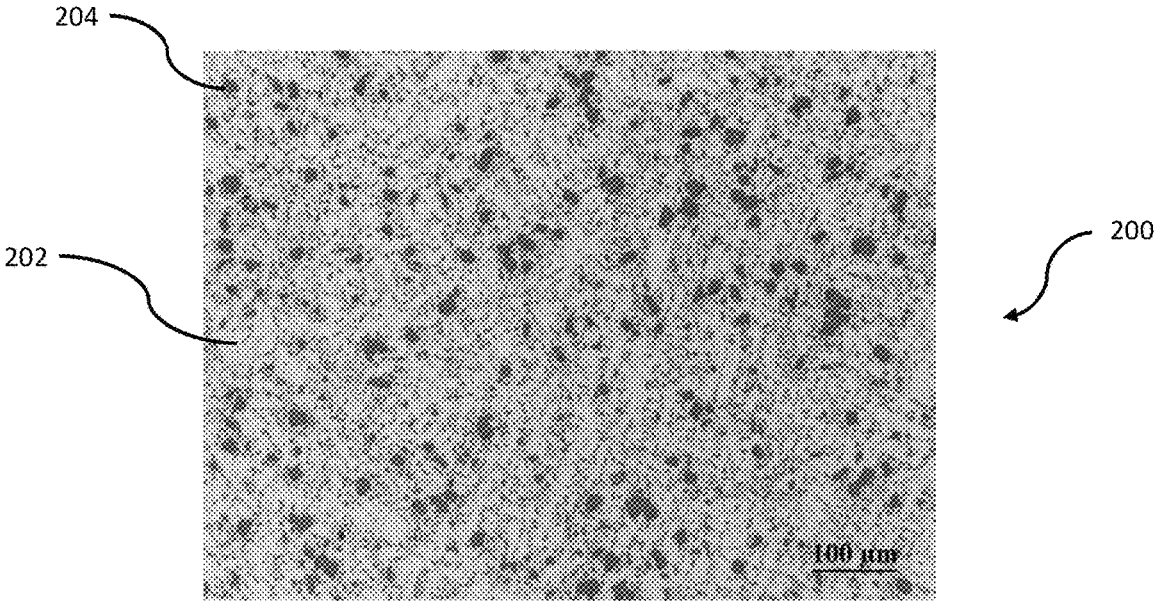
FIG. 2 is micrograph of the hypereutectic aluminum-silicon after processing with the method of eliminating microstructure inheritance, according to an exemplary embodiment.

FIG. 2 shows a micrograph 200 of the B390 Al—Si alloy casting after processing with the method of eliminating microstructure inheritance. The micrograph 200 shows a microstructure of the processed B390 Al—Si alloy having an Al matrix 202 surrounding primary Si particles 204, eutectic Si particles 206, $\alpha$-Fe($Al_{15}$(Fe,Mn)$_3Si_2$ 208, and $\beta$-Fe($Al_5FeSi$) 210. The Fe($Al_{15}$(Fe,Mn)3$Si_2$ 208, and $\beta$-Fe ($Al_5FeSi$) 210 are also referred to as the Alpha iphase 208 and Beta phase 210, respectively.

Referring to FIG. 1, the relatively large primary Si particles of micrograph 100, as compared to micrograph 200, can lead to coarse primary Si particles and eutectic Si particles in a completed cast workpiece. Coarse primary SI particles may significantly reduce the alloy ductility of cast workpiece. The Alpha phase 108 is plate-like shape in 3D and needle shape in 2D. The alpha phase is very brittle and easy crack, which significantly reduce material properties such as ductility and fatigue performance. Referring to FIG. 2, the smaller and more uniformly dispersed primary Si particles 204 and eutectic Si particles enable the completed cast workpiece to have higher strength and better wear resistance.

Figure 3:
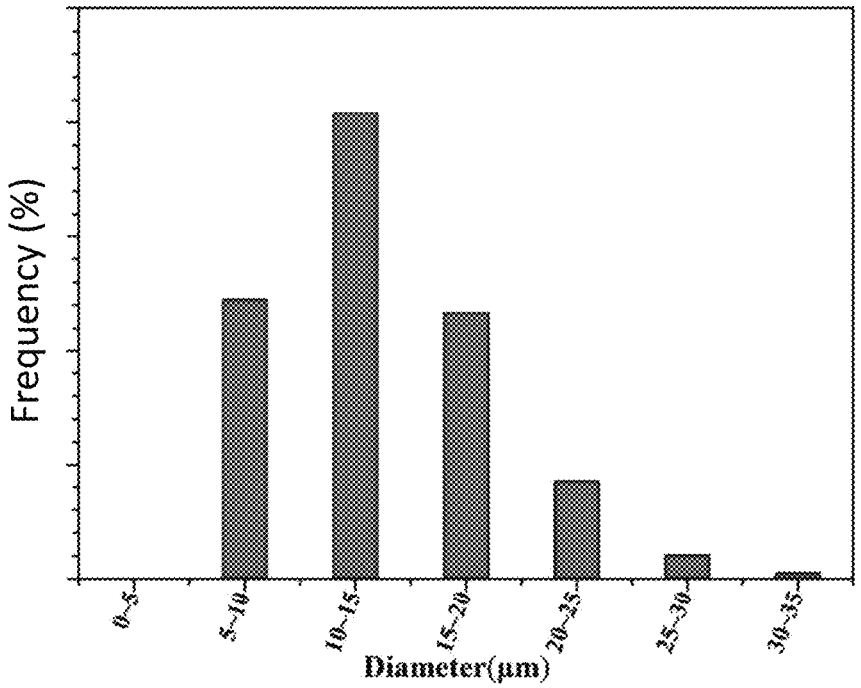
FIG. 3 is a graph showing a frequency distribution of Si particle sizes in the hypereutectic aluminum-silicon alloy of FIG. 2, according to an exemplary embodiment.
Figure 4:
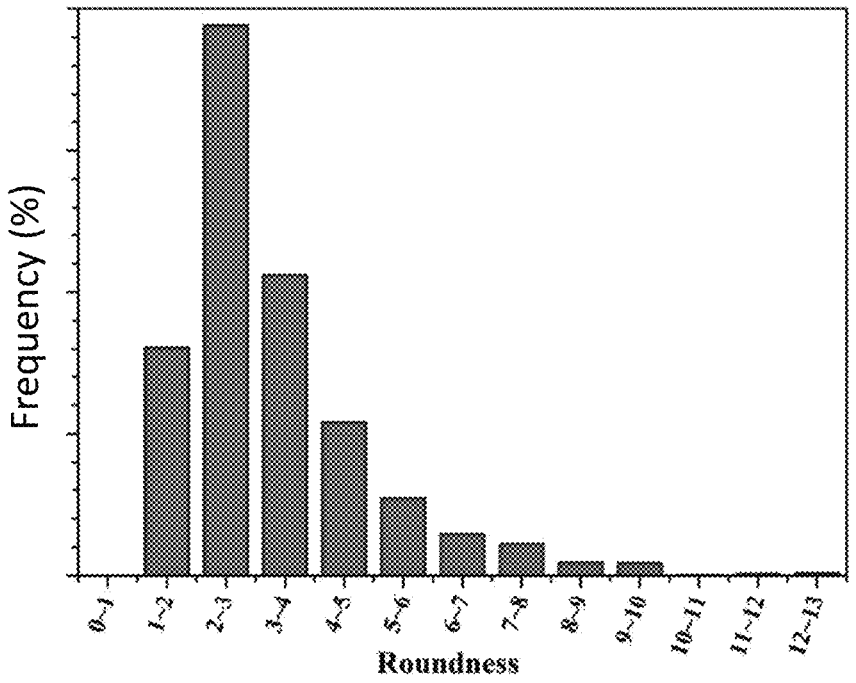
FIG. 4 a graph showing a frequency distribution of roundness of Si particles in the hypereutectic aluminum-silicon alloy of FIG. 2, according to an exemplary embodiment.

FIG. 3 is a graph showing a frequency distribution of primary Si particle sizes in the processed B390 Al—Si alloy. The primary Si particles in the processed B390 Al—Si alloy have a smaller diameter than the non-processed B390 Al—Si alloy. The nominal size of primary Si particle in the non-processed alloy is around 40-80 microns. The processed B390 Al—Si alloy has a large frequency (%) of Si particles having diameters ranging from 5 to 20 microns, particularly between 10 to 15 microns. FIG. 4 is a graph showing a frequency distribution of roundness of the Si particles in the processed B390 Al—Si alloy. The processed Al—Si alloy has a large frequency (%) of roundness ranging between 1 to 5, particularly between 2 to 3. The roundness is represented with an aspect ratio of an Si particle. A perfectly round particle is represented by a roundness of 1, which is unitless.

Figure 5:
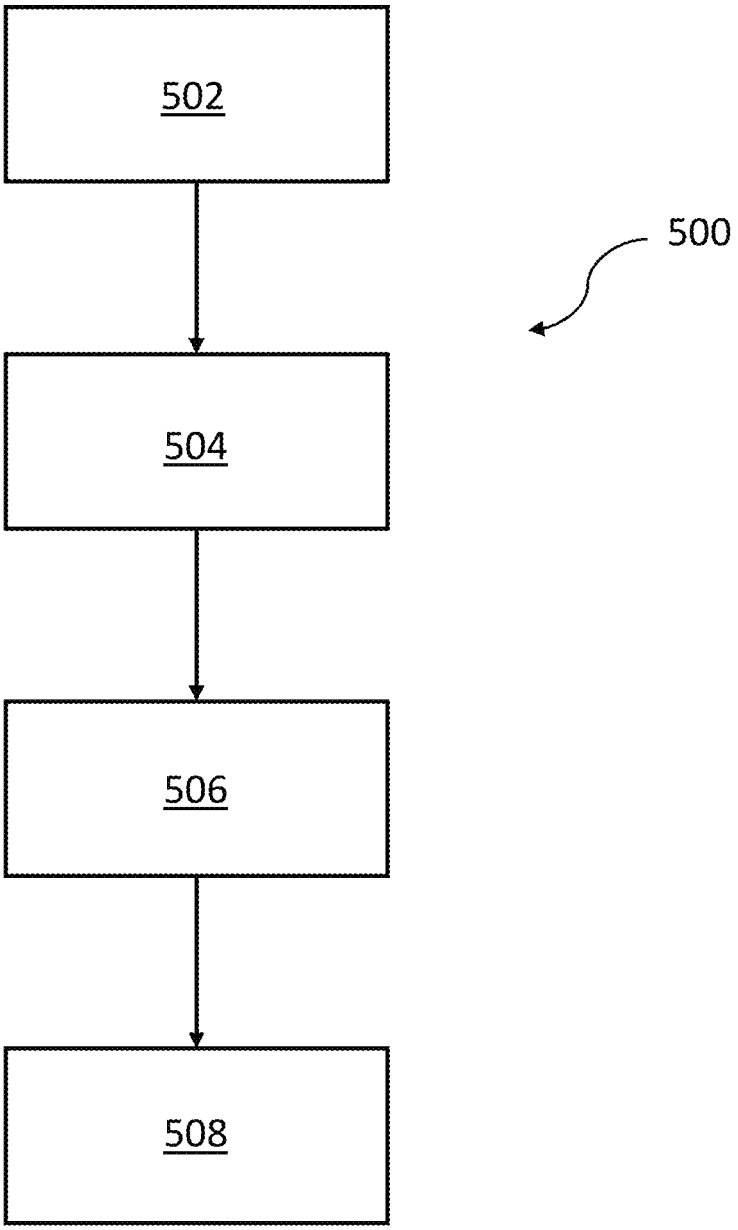
FIG. 5 is a block flow diagram of the method of eliminating microstructure inheritance of hypereutectic aluminum-silicon alloys, according to an exemplary embodiment.

FIG. 5 shows a block flow diagram of a method of eliminating microstructure inheritance of hypereutectic aluminum-silicon alloys (Method 500). The method 500 begins in Block 502, where a first amount of an Al—Si alloy is heated to a predetermined temperature above a liquidus temperature of the Al—Si alloy to transform the Al—Si alloy into a liquid state. The liquidus temperature of B390 Al—Si alloy is approximately 600° C. The Al—Si alloy in liquid state is referred to as an Al—Si alloy melt. It is preferable that the predetermined temperature is between 750° C. to 850° C., preferably 790° C. to 810° C., and more preferably 800° C.

Figure 7:
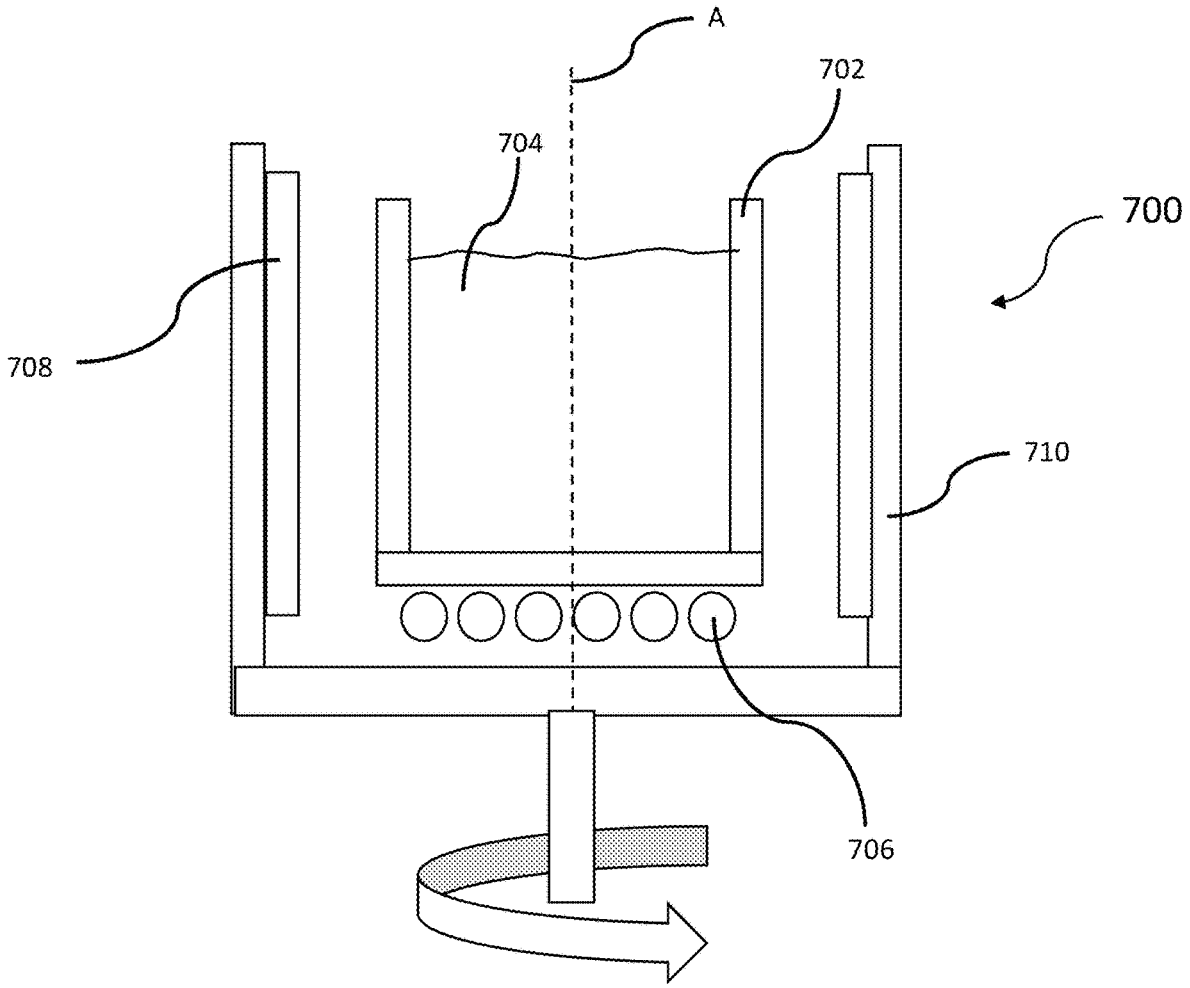
FIG. 7 is a diagrammatic cross-section of a contact-less magnetic stirring apparatus 700 configured to facilitate the method of FIG. 5, according to an exemplary embodiment.

Moving to Block 504, the Al—Si alloy melt is held at the predetermined temperature for a predetermined amount of time, preferably between 0.1 hour to 0.5 hour. Within the predetermined amount of time, the Al—Si alloy melt is continuously agitated by stirring to break down the short-range element clusters and segregation of the Si particles, which includes primary Si particle and eutectic Si particle element clusters. The Si particles are broken down to have diameters ranging from 5 to 20 microns, preferably between 10 to 15 microns, and have roundness ranging from 1 to 5, preferably between 2 to 3. The Al—Si alloy melt may be stirred by one or more of: a mechanical stirring, an ultrasonic stirring, a magnetic stirring, and a contact-less magnetic stirring, to break down the short-range element clusters and segregation of the Si particles. Contact-less magnetic stirring means the Al—Si alloy melt is stirred using a rotating magnetic field acting on the iron (Fe) in the alloy to stir the mixture without the use of a traditional magnetic stir bar disposed in the Al—Si alloy melt. An exemplary contact-less magnetic stirring apparatus is shown in FIG. 7 and disclosed in detail below.

Moving to Block 506, a second amount of the Al—Si alloy is heated above the liquidus temperature of the Al—Si alloy to form a second amount Al—Si alloy melt. The second amount of Al—Si alloy melt is not processed by a mechanical stirring, an ultrasonic stirring, a magnetic stirring, or a contact-less magnetic stirring to break down the short-range element clusters and segregation of the Si particles. The non-processed second amount of Al—Si alloy melt is blended with the processed first amount of Al—Si alloy melt to form an Al—Si casting alloy mixture. It is preferable that the weight percentage of the first amount of the Al—Si alloy melt in the Al—Si casting alloy cast mixture is between 25 to 50 weight percent (wt %), preferable between 30 to 40 wt %, and more preferably 35 wt %.

Moving to Block 508, the molten Al—Si casting alloy mixture is poured or injected in to casting mold having a predefined form factor defining an automotive work piece, such as a transmission clutch housing. The molten Al—Si casting alloy mixture is cooled and solidified to form the automotive workpiece.

Figure 6A:
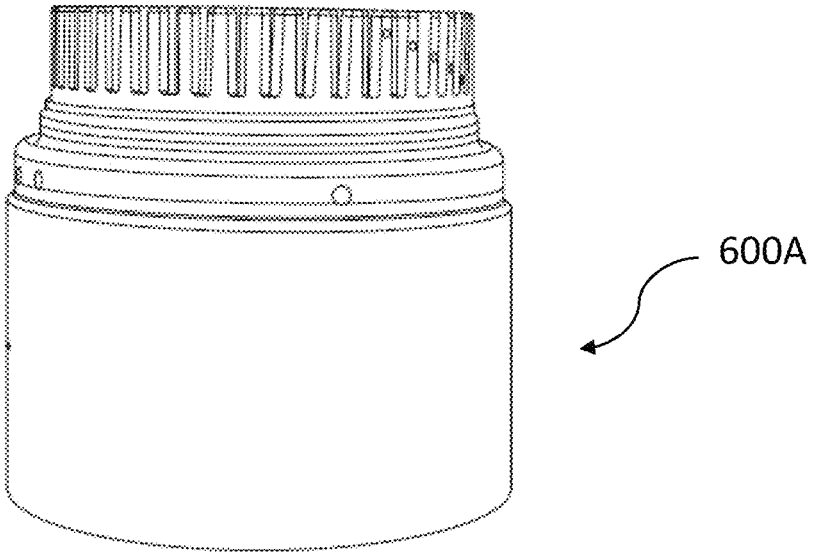
FIG. 6A is a side view of an exemplary automotive component cast from a hypereutectic aluminum-silicon processed by the method of FIG. 5, according to an exemplary embodiment.
Figure 6B:
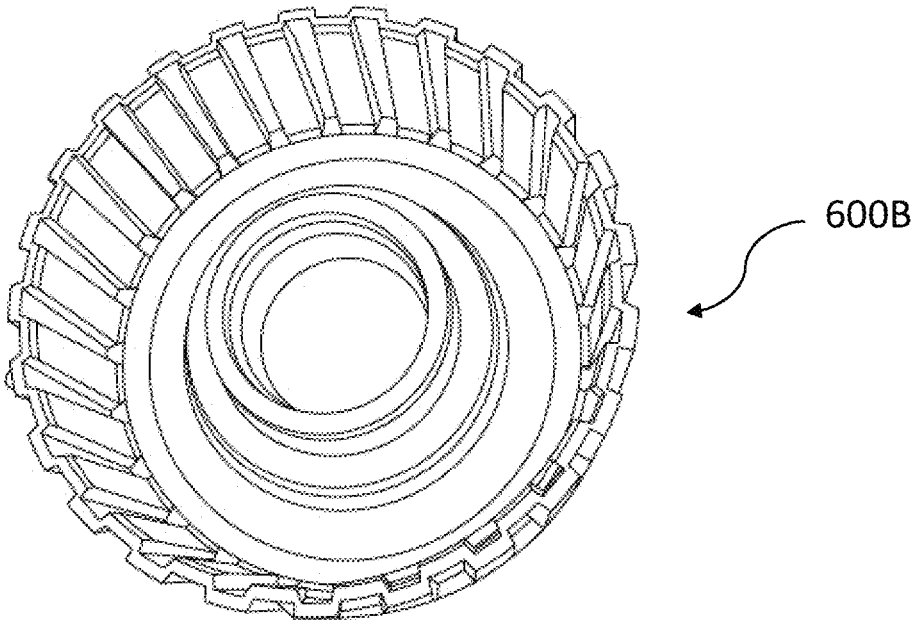
FIG. 6B is a perspective top view of the exemplary automotive component of FIG. 6A, according to an exemplary embodiment.

Shown in FIG. 6A is a sideview of an exemplary cast workpiece 600, which is a cast clutch housing for a transmission of a motor vehicle. Shown in FIG. 6B is a perspective top view of the exemplary cast workpiece 600 of FIG. 6A. While a cast transmission clutch housing is shown as an exemplary cast workpiece, it should be appreciated that the workpiece may include any automotive or non-automotive cast component that requires excellent wear and ductility properties.

FIG. 7 is a diagrammatic cross-section of contact-less magnetic stirring apparatus 700 configured to facilitate the method of FIG. 5. The apparatus 700 includes an insulated crucible 702 configured to contain a molten alloy 704, a heating element 706 to melt and maintain the molten alloy 704 at a predetermined temperature, and a plurality of magnets 708 configured to generate a rotating magnetic field sufficient to magnetically stir the molten alloy 704 within the crucible 702 about a center axis-A. The magnets 708 may be that of permanent magnets fixed to a rotating platform 710 or electric magnets configured to generate a rotating magnetic field.

Method 500 may be applied to B390 hypereutectic aluminum alloy as well as to 392, 393 hypereutectic aluminum alloys, and to near-eutetic alloys such as 336, 339, 360, 369, 383, 384, A356, A357, etc. alloys. Method 500 may be applied to other metallic alloy systems such as hypoeutectic or hypereutectic Mg alloys, and to any alloys with formation of secondary phase particles in the microstructure during solidification.

Numerical data have been presented herein in a range format. The term "about" as used herein is known by those skilled in the art. Alternatively, the term "about" includes +/−0.05% by weight". It is to be understood that this range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. While examples have been described in detail, those familiar with the art to which this disclosure relates will recognize various alternative designs and examples for practicing the disclosed method within the scope of the appended claims.

The description of the present disclosure is merely exemplary in nature and variations that do not depart from the general sense of the present disclosure are intended to be within the scope of the present disclosure. Such variations are not to be regarded as a departure from the spirit and scope of the present disclosure.

The invention claimed is:

1. A method of eliminating microstructure inheritance in a hypereutectic aluminum-silicon (Al—Si) alloy, comprising:

providing an Al—Si alloy having eutectic Si particle element clusters;

heating a first amount of the Al—Si alloy to a predetermined temperature above a liquidus temperature of the Al—Si alloy to form a first amount melt;

holding the first amount melt at the predetermined temperature for a first predetermined amount of time;

stirring the first amount melt for a second predetermined amount of time sufficient to break down the eutectic Si particle element clusters to diameters ranging from 5 microns to 20 microns to form a stirred first amount melt;

heating a second amount of the Al—Si alloy above the liquidus temperature of the Al—Si alloy to form a second amount melt; and mixing the stirred first amount melt with the second amount melt to form a processed Al—Si alloy.

2. The method of claim 1, wherein the second predetermined amount of time is less than the first predetermined amount of time.

3. The method of claim 1, wherein the predetermined temperature is greater than 800° C.

4. The method of claim 1, wherein the predetermined temperature is between about 750° C. to about 850° C.

5. The method of claim 4, wherein the predetermined temperature is between about 790° C. to about 810° C.

6. The method of claim 1, wherein the first predetermined amount of time is between 0.1 hour to 0.5 hour.

7. The method of claim 6, wherein the second predetermined amount of time is equal to and concurrent with the first predetermined amount of time.

8. The method of claim 1, wherein stirring the first amount melt includes contact-less magnetic stirring.

9. The method of claim 1, wherein the processed Al—Si alloy includes from about 25 weight percent (wt %) to about 50 wt % of the first amount of melt.

10. A method of casting a workpiece, comprising:

providing an Al—Si alloy;

heating a first amount of the Al—Si alloy to a processing temperature between about 750° C. to about 850° C. to form a first Al—Si alloy melt;

stirring the first Al—Si alloy melt while maintaining the first Al—Si alloy melt at the processing temperature for a predetermined processing time to form a processed Al—Si melt;

heating a second amount of the Al—Si alloy above a liquidus temperature of the Al—Si alloy to form a second Al—Si alloy melt;

mixing the second Al—Si alloy melt to the processed Al—Si alloy melt to form a casting alloy mixture; and pouring the casting alloy mixture into a mold cavity defining the workpiece;

wherein the predetermined processing time is between about 0.1 hour to about 0.5 hour; and wherein the casting alloy mixture includes about 30 weight percent (wt %) to about 40 wt % of the processed Al—Si alloy melt.

11. The method of claim 10, wherein the second Al—Si alloy melt is not stirred.

12. The method of claim 10, wherein the casting alloy mixture includes about 35 wt % of the processed Al—Si alloy melt.

13. A method of processing a hypereutectic aluminum-silicon (Al—Si) alloy for casting, comprising:

heating an Al—Si alloy to form an Al—Si alloy melt;

separating the Al—Si alloy melt into a first portion and a second portion;

stirring the first portion of the Al—Si alloy melt for a predetermined time at a predetermined temperature to form a stirred first portion Al—Si alloy melt; and mixing the second portion of the Al—Si alloy melt to the stirred first portion Al—Si alloy melt to form a processed Al—Si casting alloy; and wherein the processed Al—Si casting alloy comprises about 30 weight percent (wt %) to about 40 wt % of the stirred first portion Al—Si alloy melt and a remainder wt % of the second portion of the Al—Si alloy melt.

14. The method of claim 13, wherein the predetermined time is from about 0.1 hour to about 0.5 hour.

15. The method of claim 13, wherein the predetermined temperature is from about 750° C. to about 850° C.

16. The method of claim 13, wherein stirring the first portion of the Al—Si alloy melt includes contact-less magnetic stirring.

17. The method of claim 10, wherein stirring the first Al—Si alloy includes contact-less magnetic stirring.

18. The method of claim 10, wherein the Al—Si alloy includes eutectic Si particle element clusters, and wherein the predetermined processing time is sufficient to break down the eutectic Si particle element clusters to diameters ranging from 5 microns to 20 microns.

19. The method of claim 10, wherein the processing temperature is between about 790° C. to about 810° C.

20. The method of claim 13, wherein the processed Al—Si casting alloy comprises about 35 wt % of the stirred first portion Al—Si alloy melt.

* * * * *